United States Patent [19]

Deurloo

[11] 3,981,555

[45] Sept. 21, 1976

[54] CONNECTOR PLUG WITH PERMANENTLY CONNECTED CABLE

[75] Inventor: Johannis Martinis Deurloo, Emmen, Netherlands

[73] Assignee: Draka Kabel B.V., Hamerstraat, Netherlands

[22] Filed: June 24, 1975

[21] Appl. No.: 589,762

[30] Foreign Application Priority Data

July 4, 1974 Netherlands ..... 7409034

[52] U.S. Cl. ..... 339/105; 339/223 R

[51] Int. Cl.[2] ..... H01R 13/58

[58] Field of Search ..... 339/105, 223 AU

[56] References Cited

UNITED STATES PATENTS 2,932,685 4/1960 Raila et al. ..... 339/223 R X 3,810,075 5/1974 Turner ..... 339/105

*Primary Examiner*—Roy Lake

*Assistant Examiner*—DeWalden W. Jones

*Attorney, Agent, or Firm*—Frank R. Trifari; David R. Treacy

[57] ABSTRACT

A connector plug with a permanently connected cable, provided with a housing consisting of two shells in which transverse partitions comprising cut-outs are provided for strain relief of the cable. The cable can be forced into these cut-outs which are staggered with respect to each other such that the cable is curved.

3 Claims, 2 Drawing Figures

CONNECTOR PLUG WITH PERMANENTLY CONNECTED CABLE

Figure 1:
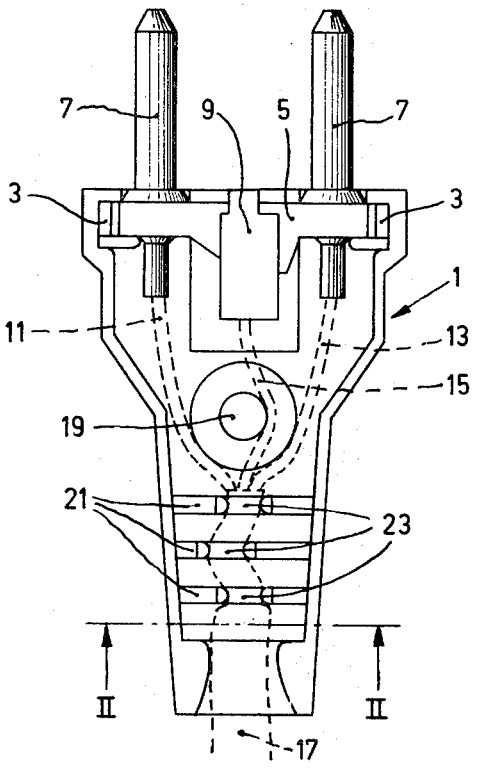

The invention relates to a connector plug with permanently connected cable, comprising an elongate housing which has an opening on one end for the passage of the cable, and at least two openings on the opposite end wherethrough contact pins project or wherethrough contact sockets are accessible, the said housing consisting of two shells which are arranged one over the other by way of their edges.

During assembly of such connector plugs the cores of the cable are electrically and mechanically connected to connection terminals of the pins or sockets. At the same time, strain relief is provided for the cable by anchoring the cable in the housing. To this end, for example, the cable is fed through an S-shaped duct, or is secured by means of a clamping piece which is to be screwed down. The provision of the known strain reliefs is comparatively time-consuming, and thus has an adverse effect on the price of the assembled connector plug.

The invention has for its object to realize a construction in which the provision of the strain relief requires hardly any time. To this end, the connector plug according to the invention is characterized in that for the strain relief of the cable at least three transverse partitions are provided in one of the shells, each partition comprising a cut-out which opens into its free side and which includes a lower portion having parallel sides near its closed end, the depth thereof being larger than and the width thereof being smaller than the largest and the smallest, respectively, transverse dimension of the cable, the said cut-outs being positioned such that cut-outs which are situated directly one behind the other are staggered in the transverse direction with respect to each other.

In the connector plug according to the invention, the cable can be arranged in the cut-outs from the open side in one operation. In some cases the depth of a shell is smaller than the cable thickness, so that the required depth cannot be realized within the shell. This drawback is avoided in a preferred embodiment of the connector plug according to the invention, which is characterized in that the transverse partitions project above the edge of the shell so far that they reach substantially as far as the bottom of the other shell.

In order to facilitate the fitting of the cable in the cut-outs, a further preferred embodiment yet according to the invention is characterized in that the cut-out gradually widens from the portion comprising the parallel sides in the direction of the open end.

The invention will be described in detail hereinafter with reference to the drawing.

Figure 2:
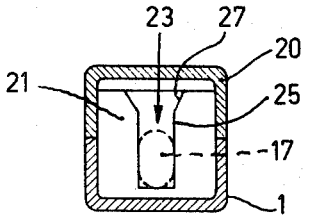

FIG. 1 is a plan view of a shell of a connector plug according to the invention, and FIG. 2 is a cross-sectional view taken along the line II—II of the same shell after assembly with the other shell.

The shell 1 of synthetic material which is shown in FIG. 1 is provided on the front side with two grooves 3 in which an insulating bridge portion 5 has been inserted, the said portion comprising two pin contacts 7 and two earthing contacts 9 (only one visible). Three cores 11, 13, 15 of a cable 17 (denoted by broken lines) are electrically connected to these contacts. The shell 1 furthermore comprises a pin 19 of synthetic material which is inserted through an opening (not shown) in the second shell 20 (see FIG. 2) during assembly, after which the two shells are riveted together by deformation of the end of the pin. For strain relief of the cable 17, the shell 1 comprises three successively arranged transverse partitions 21 which are so high that they reach as far as the bottom of the second shell 20, each partition comprising a cut-out 23 having a lower portion 25 whose sides are parallel, and an upper portion 27 which gradually widens in the direction of the open end. Consequently, the cable 17 can be readily inserted from the top in the correct position with respect to the lower portion 25, and can subsequently be forced into this portion. The lower portion 25 is narrower and deeper than the thickness of the cable 17, so that the cable can be completely clamped in this portion; this already to a certain extent prevents the tensile forces exerted on the cable from being transferred to the connections between the cores 11, 13, 15 and the contacts 7, 9. In order to eliminate this possiblility, completely, the cut-outs 23 in the three transverse partitions are positioned such that cut-outs situated directly one behind the other are staggered in the transverse direction with respect to each other. As is clearly shown in FIG. 1, the cable is thus forced to curve, thus ensuring optimum strain relief. It will be obvious that more than three transverse partitions can be provided, if desired.

Within the scope of the invention, other embodiments are alternatively possible. Instead of pins 7, the connector plug can comprise, for example, contact sockets. The number of pins or sockets may also be larger than two. The connecting of the two shells to each other can also be performed in a manner other than by means of pin 19, for example, by glueing or welding the edges to each other. The table 17 may have a round, oval, rectangular or any other section.

What is claimed is:

1. A connector plug with permanently connected cable, comprising an elongate housing which has an opening on one end for the passage of the cable and at least two openings on the opposite end wherethrough contact pins project or wherethrough contact sockets are accessible, the said housing consisting of two shells which are arranged one on the other by way of their edges, characterized in that for the strain relief of the cable (17) at least three transverse partitions (21) are provided in one of the shells (1), each partition comprising a cut-out (23) which opens into its free side and which includes a lower portion (25) having parallel sides near its closed end, the depth thereof being larger than and the width thereof being smaller than the largest and the smallest, respectively, transverse dimension of the cable (17), the said cut-outs (23) being positioned such that cut-outs (23) which are situated directly one behind the other are staggered in the transverse direction with respect to each other.

2. A connector plug as claimed in claim 1, characterized in that the transverse partitions (21) project above the edge of the shell (1) so far that they extend substantially as far as the bottom of the other shell (20).

3. A connector plug as claimed in claim 1, characterized in that the cut-out (23) gradually widens from the portion (25) having parallel sides in the direction of the open end.

* * * * *